US006135581A

United States Patent [19]

Kopp et al.

[11] Patent Number: 6,135,581

[45] **Date of Patent: *Oct. 24, 2000**

[54] COUNTERTOP KIT

[75] Inventors: Dennis Allen Kopp, Pittsfield; Lynn Winston, Sturbridge, both of Mass.; Chad Daniel Lehman, Elkhart, Ind.

[73] Assignee: General Electric Company, Schenectady, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 09/070,549

[22] Filed: Apr. 30, 1998

[51] Int. Cl.[7] ..... A47B 96/18

[52] U.S. Cl. ..... 312/140.3; 312/140.1; 108/27; 4/631

[58] Field of Search ..... 312/140.1, 140.2, 312/140.3, 140.4, 204; 52/717.04, 716.8, 782.22, 796.12, 797.1, 782.2, 800.12; 108/27; 4/631, 632, 633, 634, 635, 636

[56] References Cited

U.S. PATENT DOCUMENTS

| | | | |
|---|---|---|---|
| 2,734,789 | 2/1956 | Wilson, Jr. | 312/140.3 X |
| 2,980,477 | 4/1961 | Hansen | 108/27 |
| 2,980,569 | 4/1961 | Wening | 108/27 |
| 3,007,213 | 11/1961 | Hobbs . | |
| 4,199,910 | 4/1980 | Priore . | |
| 4,558,553 | 12/1985 | Kolk | 108/27 |
| 4,663,912 | 5/1987 | Vinther . | |
| 4,716,840 | 1/1988 | Tringali et al. | 108/27 |
| 4,914,888 | 4/1990 | Hanson . | |
| 5,018,628 | 5/1991 | Schenck et al. | 312/140.3 X |
| 5,149,575 | 9/1992 | Soifer . | |
| 5,330,262 | 7/1994 | Peters | 108/27 X |
| 5,424,108 | 6/1995 | Whetstone . | |
| 5,479,864 | 1/1996 | Kemp . | |
| 5,569,505 | 10/1996 | Nichols . | |
| 5,733,022 | 3/1998 | Whetstone | 312/140.4 |

FOREIGN PATENT DOCUMENTS

| | | | |
|---|---|---|---|
| 719619 | 10/1965 | Canada | 108/27 |
| 0 738 487 A1 | 10/1996 | European Pat. Off. . | |
| 2607687 | 6/1988 | France | 108/27 |
| 3618357 | 10/1987 | Germany | 108/27 |
| 94 11 729 U | 9/1994 | Germany . | |
| 8005534 | 5/1982 | Netherlands | 108/27 |
| 1 226 352 | 3/1971 | United Kingdom . | |

*Primary Examiner*—Peter M. Cuomo
*Assistant Examiner*—Hanh V. Tran

[57] ABSTRACT

A countertop assembly kit is designed for ease of assembly with a resulting superior appearance at minimal cost while meeting all functional requirements. It comprises some combination of the following items. A rigid substrate having pre-formed grooves in its upper and front surfaces. An upright member includes an underlying rib for fitting engagement with the upper surface groove for firm mounting on the substrate and an upper longitudinally extending groove in its upper surface. A finishing T-cap member of plastic material has a planar head and an integral downwardly projecting ledge for fitting engagement with the upper groove so as to be engaged with and coextensively overlie the upper surface of the upright member. A plastic backsplash member coextensively overlies the front surface of the upright member. A plastic countertop coextensively overlies the upper surface of the substrate while allowing for mounting of the upright member. Finally, an edge profile includes an upright bight engaged with the front surface of the substrate, an upper flange engaged with the open sided channel of the countertop, an intermediate flange engaged with the front longitudinally extending groove of the substrate, and a lower flange engaged with the lower surface of the substrate. The plastic members are laminated; co-extruded or tri-extruded of materials chosen for optimal surfacing characteristics yet at minimal expense and mutually abut for sealing continuity.

9 Claims, 5 Drawing Sheets

COUNTERTOP KIT

BACKGROUND OF THE INVENTION

1. Field of the Invention

The present invention relates generally to surface coverings of the type generally found on bathroom and kitchen countertops. More particularly, the invention relates to a kit for application of a plurality of components to a corestock or ABS layer resulting in an assembly having the appearance of a seamless unitary structure. The plurality of components includes one or more of an edge profile strip, a countertop, a backsplash, and a T-cap.

2. Description of the Prior Art

Surface tops, particularly kitchen countertops are found in virtually every residence in the country. Many restaurants and other food dispensing establishments also employ countertops as a functional part of a kitchen area or a serving area. Necessary characteristics of any kitchen countertop include a flat top surface which is resistant to food stains, impervious to liquid, resistant to scratches and other surface marrings, and is readily cleaned. Many of these same characteristics are required in other surface tops such as bathroom vanity tops, table tops, and work bench tops. Any surface top must also be attractive to be marketable. Attractiveness of a surface top in large part results from a pleasing color or surface pattern. However, unique edge treatments, provision of a backsplash, and a seamless one piece appearance are also important.

Surface tops utilizing liquid impervious laminates are very prevalent. The surface tops comprise a rigid corestock and the laminate as a relatively thin top layer. The laminate may comprise resin impregnated paper sheets which have been subjected to pressure and heat to form a hardened rigid sheet product. The laminates can be made in any color and can have any imaginable pattern printed onto its surface. While relatively thin, for example, up to about 50 mils in thickness, the laminates have all the characteristics needed in a surface top They are readily cut to size and adhered to the corestock. Edge moldings are often used with the laminate to finish the surface top. The edge moldings, though, are limited in available shapes and tend to create a noticeable seam where they abut against the laminate surface top.

More recently there has been developed counter and vanity tops which are made by a casting process. Basically, a mold having the shape and size of a surface top is made and liquid resin cast into it When set, a surface top is created which is durable and attractive. It can be transported and secured to base cabinets in the kitchen or bathroom. A side molding is adhered to the flat surface or the flat surface edge can be routed to a desired shape. However, the surface top is difficult to install because of its weight. Ideally, it is formed in the shop; this also is a drawback because of a need to transport it.

There is still a need for an improved surface top which has all the physical characteristics that the home owner and business proprietor have come to expect. Additionally, any such product must be attractive and readily installed. In accord with this need, there has now been developed an edge molding and surface top assembly which is readily installed and is amenable to varied design shapes. The resultant assembly is durable, resistant to food stains, liquid spills, accidental bumps and marrings, and possesses a long lasting attractiveness.

The patent literature is representative of the developments in this industry and a number of pertinent patents will now be reviewed.

U.S. Pat. No. 5,569,505 to Nichols discloses a panel or slab construction which includes a fiber core glued between two facing sheets of thin metal and having edges of the core spaced inwardly of the slab from the associated edges of the metal facing sheets thereby defining a recess. A decorative molding member having a predetermined shaped edge extends into the recess and is fixed to the edges of the metal sheets thereby concealing the adjacent edges of the core. At least one side of the molding is stepped approximately the thickness of the metal sheet such that the sheet overlies the molding with its exposed surface forming a flush transition with the surface of the shaped molding edge. A seamless veneer may thereby be formed and fixed to the steel facing sheet and associated molding as a single piece to finish the panel in a manner simulating the appearance of a solid slab.

In U.S. Pat. No. 5,479,864 to Kemp, a nosing assembly is provided for a desk work surface having a front end portion and comprises a lower block attached to the underside of the desk work surface, the lower block having a first exterior surface. A nosing is attached to the first exterior surface, and substantially surrounds and conforms to the first exterior surface. The desk work surface is thereby provided with a nosing to protect the desk work surface and people in its vicinity.

U.S. Pat. No. 5,424,108 discloses an edge molding shaped to mount on a corestock in a cooperative relationship with a substantially flat surface top to form a two piece surface top assembly which is easy to install yet appears to be seamless. The edge molding has a facing wall, an integral first ledge and an integral second ledge, each extending at substantially right angles from the facing wall. An inside face of the facing wall has at least one longitudinally running excess adhesive flow-out groove and the inside faces of the ledges have longitudinally running gripper ridges. The second ledge preferably also has a drip channel on its outside face to interrupt the flow of spilled liquid. The edge molding and surface top are positioned onto the corestock and adhesively secured thereto. An edge area where the surface top overlaps the edge molding is capable of being routed to a desired shape.

As disclosed in U.S. Pat. No. 5,149,575 to Soifer, the bumper of that invention is utilized in conjunction with a corner edge of a table, piece of furniture, counter or similar article. The bumper includes a corner edge cover having wall segments overlaid on the corner sidewalls. The cover wall segments are joined to form an angle which corresponds to the geometric configuration of the underlying corner structure. A resilient shield wall includes a substantially semi-cylindrical wall segment, spaced away from the corner edge cover by an optimized stand-off distance, and tangentially extending wall segments bridging opposing sides of the arcuate wall segment with outer regions of the cover wall segments. The corner edge cover and the shield wall are integral and are geometrically configured to optimally absorb energy of an impact through deformation of the shield wall and distribution of the impact load over the cover wall segments and top plate. A top plate is integrally connected to the top edges of the corner wall segments to enhance the energy absorption capabilities of the bumper and provide a convenient surface for removably mounting the bumper to the corner structure with double-backed adhesive film.

In U.S. Pat. No. 4,199,910, an extruded T-shaped edge finishing strip has its tongue divided by a series of narrow abutting fingers of oblong section arranged in parallel and diagonally with their centers spaced along the original line of junction between the tongue and the face of the strip.

Corresponding ends of the fingers are offset relative to the other ends of the appropriate adjacent fingers to enable the fingers to slide relative to each other or to spread apart as the face is bent as required by the curvature of the edge to be finished by the strip. Apparatus for thus modifying the tongues of such strips has a flat support having a channel extending lengthwise thereof and dimensioned to receive the tongue of the strip with the undersurface of the face resting on the support. The channel passes between two gears having their upper faces substantially flush with the support, one gear a driving gear and the other one an idler, and the gears are spaced so that the tongue is such a force fit therein that the fingers are formed by the distortion of the tongues by the coaction of the gears.

It was with knowledge of the foregoing that the present invention has been conceived and is now reduced to practice.

SUMMARY OF THE INVENTION

The present invention relates to a countertop assembly kit designed for ease of assembly with a resulting superior appearance at minimal cost while meeting all functional requirements. It comprises some combination of the following items. A rigid substrate having pre-formed grooves in its upper and front surfaces. An upright member includes an underlying rib for fitting engagement with the upper surface groove for firm mounting on the substrate and an upper longitudinally extending groove in its upper surface. A finishing T-cap member of plastic material has a head and an integral downwardly projecting ledge for fitting engagement with the upper groove so as to be engaged with and co-extensively overlie the upper surface of the upright member. A plastic backsplash member co-extensively overlies the front surface of the upright member. A plastic countertop co-extensively overlies the upper surface of the substrate while allowing for mounting of the upright member. Finally, an edge profile includes an upright bight engaged with the front surface of the substrate, an upper flange engaged with the open sided channel of the countertop, an intermediate flange engaged with the front longitudinally extending groove of the substrate, and a lower flange engaged with the lower surface of the substrate. The plastic members are laminated, co-extruded, or tri-extruded, of materials chosen for optimal surfacing characteristics yet at minimal expense and mutually abut for sealing continuity.

A primary feature of the invention, then, is to provide a kit for assembly of a countertop designed for ease of assembly with a resulting superior appearance at minimal cost while meeting all functional requirements.

Still another feature of the invention is to provide such a kit in which the plastic members are laminated, of co-extruded or tri-extruded of materials chosen for optimal surfacing characteristics yet at minimal expense and which mutually abut to insure sealing continuity.

A further feature of the invention is to provide such a kit in which the plastic material is laminated with an overlying surface which is resistant to chemicals, stains, high temperature, soft to the touch, and readily renewable and with an underlying surface which exhibits high impact resistance, is recyclable and inexpensive.

Still another feature of the invention is to provide such a kit in which the plastic material is co-extruded or tri-extruded, the overlying surface material of the top one or two surfaces being a polyester, preferably filled polybutylene terephthalate and the underlying surface material being acrylonite butadiene styrene (ABS).

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and together with the description, serve to explain the principles of the invention in general terms. Like numerals refer to like parts throughout the disclosure.

BRIEF DESCRIPTION OF THE DRAWINGS

FIG. 4 is an exploded elevation view, in section, illustrating in greater detail a portion of FIG. 2;

DETAILED DESCRIPTION OF THE PREFERRED EMBODIMENTS

Figure 1:
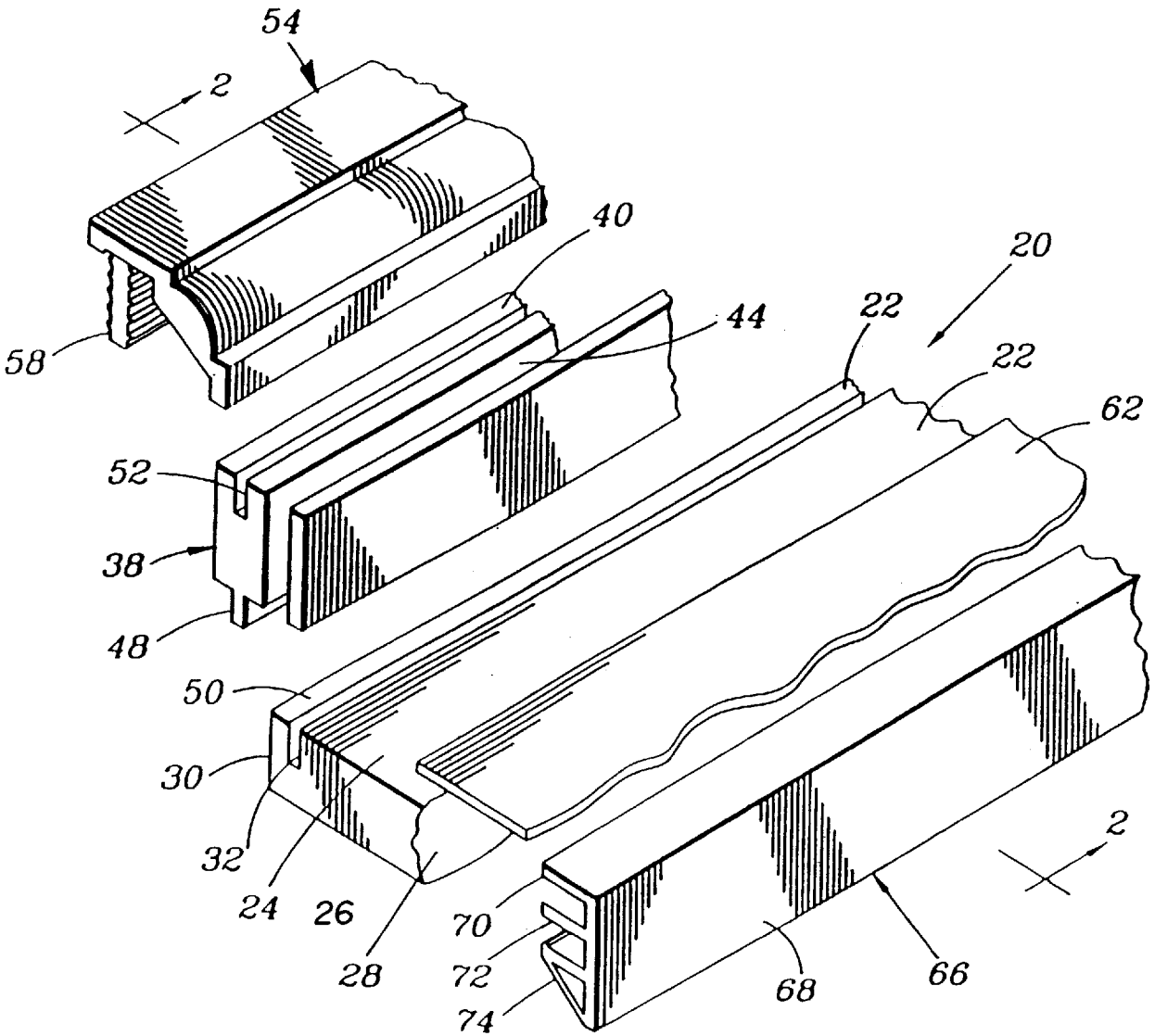
FIG. 1 is an exploded perspective view of a countertop assembly embodying the invention.
Figure 2:
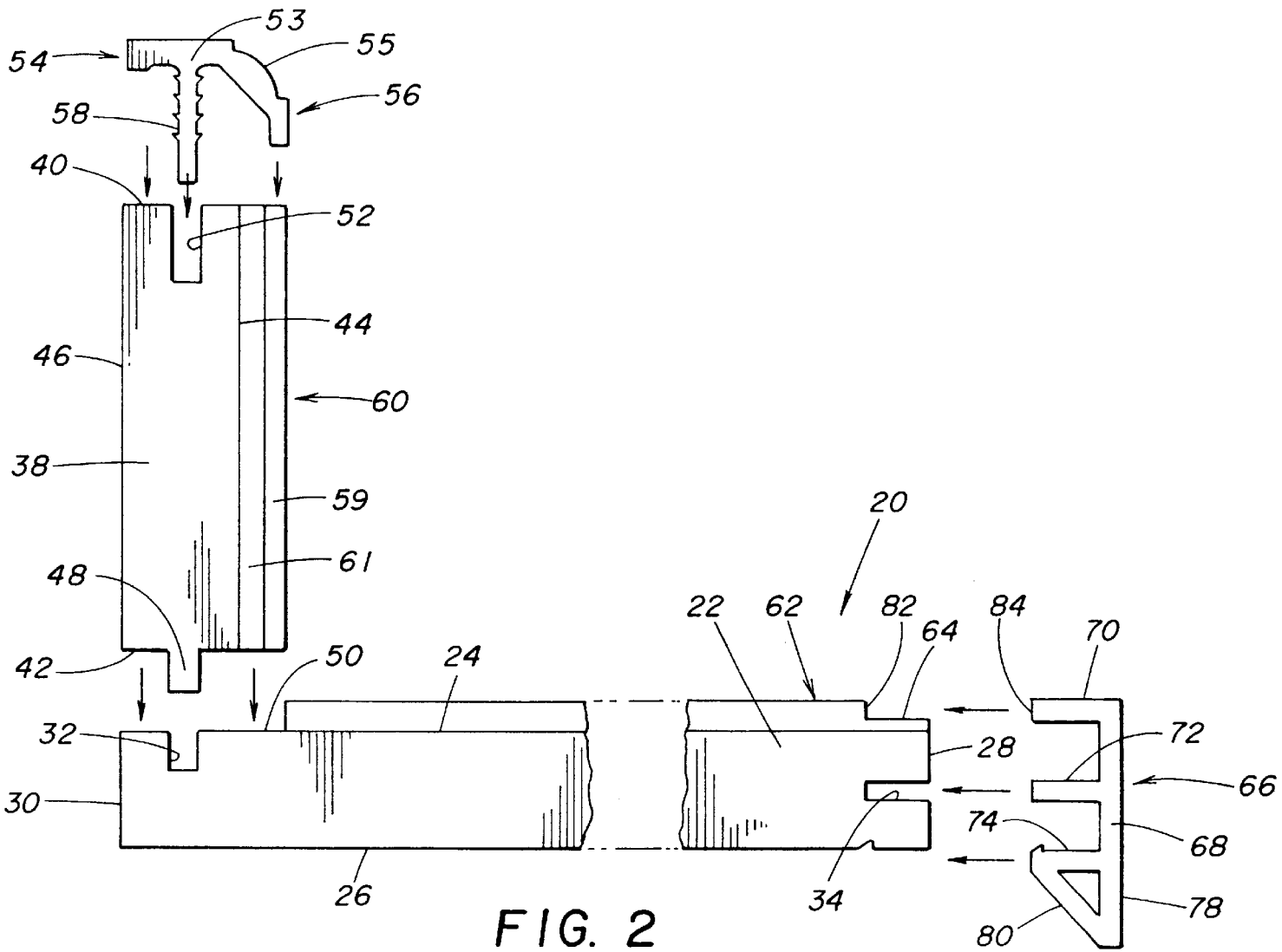
FIG. 2 is a cross section view taken generally along line 2—2 in FIG. 1

Turn now to the drawings and, initially, to FIGS. 1 and 2 which illustrate a countertop assembly 20 embodying the present invention. The countertop assembly is provided as a kit and so designed as to be easily assembled and such that, when assembled, exhibits a resulting superior appearance, with all of these benefits achieved at minimal cost while meeting all functional requirements.

The countertop assembly 20 includes a substantially rigid substrate 22 which has substantially flat upper and lower surfaces 24, 26, respectively, extending between front and rear surfaces 28, 30, respectively. The substrate 22 may be of any suitable material, substrates for countertop assemblies typically being composed of particle board, plywood, or the like and typically have a nominal thickness of ¾ inch although such a dimension is not intended to be restrictive of the protection to be provided the inventors. The front and rear surfaces 28, 30 lie in planes which are transverse, often perpendicular, to the upper and lower surfaces 24, 26. The substrate may have a first longitudinally extending groove 32 routed or otherwise formed into the upper surface 24 proximate to and spaced from the rear surface 30.

A longitudinally extending groove 34, similarly to groove 32 if any, is routed or otherwise formed into the front surface 28 intermediate the upper and lower surfaces 24, 26, respectively. Additionally, the substrate 22 has a longitudinally extending notch routed or otherwise suitably formed into the lower surface 26 proximately spaced from the front surface 28.

An upright member 38 is intended for mounting on the substrate 22 at a location adjacent the rear surface 30. As with the substrate 22, the upright member 38 typically have a nominal thickness of ¾ inch and be composed of particle board, plywood, or the like. It includes upper and lower spaced surfaces 40, 42, respectively, front and rear spaced surfaces 44, 46, respectively, and may include as an option an underlying longitudinally extending rib 48 dimensioned for fitting engagement with the longitudinally extending groove 32 in the upper surface 24 of the substrate 22. The upright member 38 can be firmly mounted on a mounting region 50 of the substrate with the lower surface 42 of the upright member engaged with the mounting region 50 of the upper surface 24 of the substrate 22.

Additionally, the upright member 38 has an upper longitudinally extending groove 52, also routed or otherwise suitably formed into the upper surface 40. A finishing T-cap member 54 of plastic material has a head 56 and an integral downwardly projecting ledge 58 dimensioned for fitting engagement with the upper longitudinally extending groove 52 such that, in its final position, the head is engaged with and co-extensively overlies the upper surface 40 of the upright member 38. The front of the head 56 is a laminae 55 of polybutylene terephthalate (PBT) and the supporting substrate 53 is acrylonitrile-butadiene-styrene (AS). The laminate 55 may have a decorative surface 57.

Figure 2A:
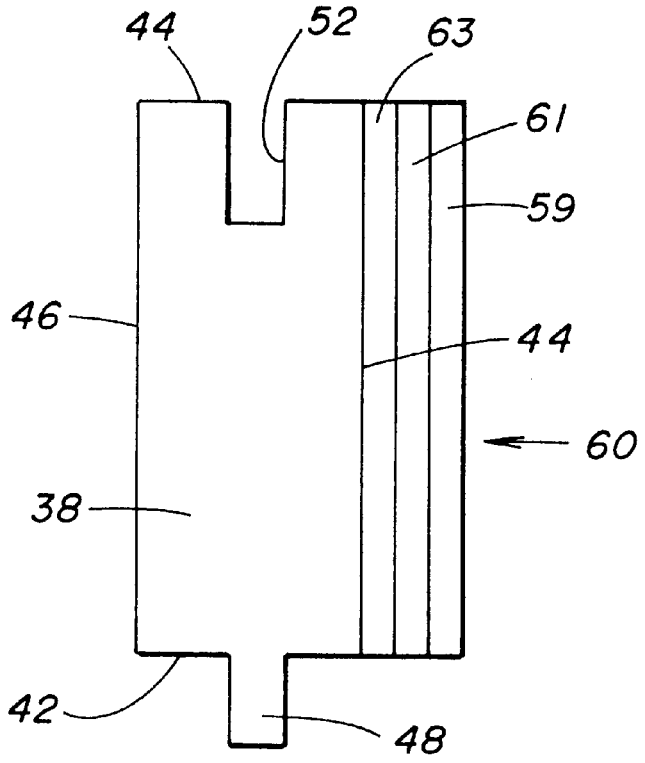
FIG. 2A is another embodiment of the backsplash member illustrating a 3 layer laminate composite laminated over a substrate.
Figure 2B:
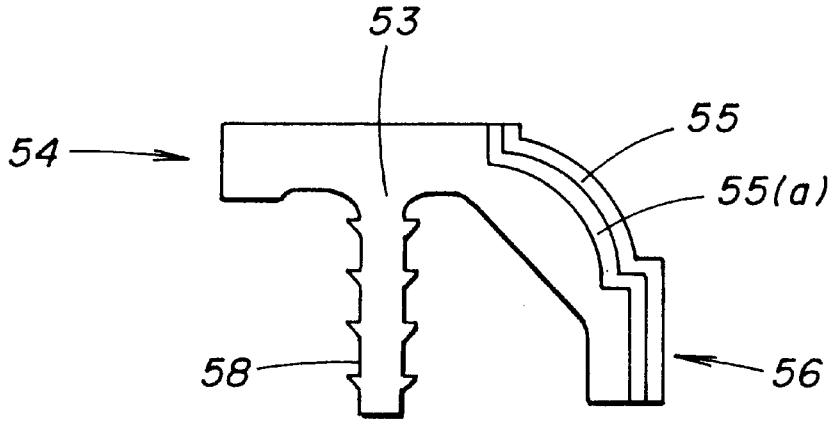
FIG. 2B is another embodiment of the T-cap member illustrating a multi-layer laminate of an outer layer comprising PBT and an adjoining layer comprising PBT.

FIG. 2B is another embodiment of the T-cap wherein a multi-layer laminate laminated to substrate 53 comprising a two layer laminate composite 55 and 55*a* with each layer comprising PBT.

A plastic backsplash member 60 is also mounted on the upright member and co-extensively overlies the front surface of the upright member. In this embodiment illustrated in FIG. 2, the backsplash member 60 comprises a two layer composite laminate with the outer layer being PBT and the supporting layer being ABS.

In FIG. 2A, there is illustrated another embodiment of this invention wherein backsplash member 60 comprises a multilayer laminate composite 60 laminated to upright member 38. The outer layer 59 is PBT, and the adjoining layer 61 is also PBT and the supporting layer 63 is ABS.

A plastic countertop 62 is also mounted on and co-extensively overlies the upper surface 24 of the substrate 22 to a location uniformly spaced from the rear surface 30 of the substrate. Thus as seen in FIG. 2, the positioning of the plastic countertop 62 on the upper surface 24 of the substrate 22 defines the mounting region 50. The plastic countertop 62 also has an open sided longitudinally extending channel 64 distant from the rear surface 30 and adjacent the front surface of the substrate 22.

Figure 5:
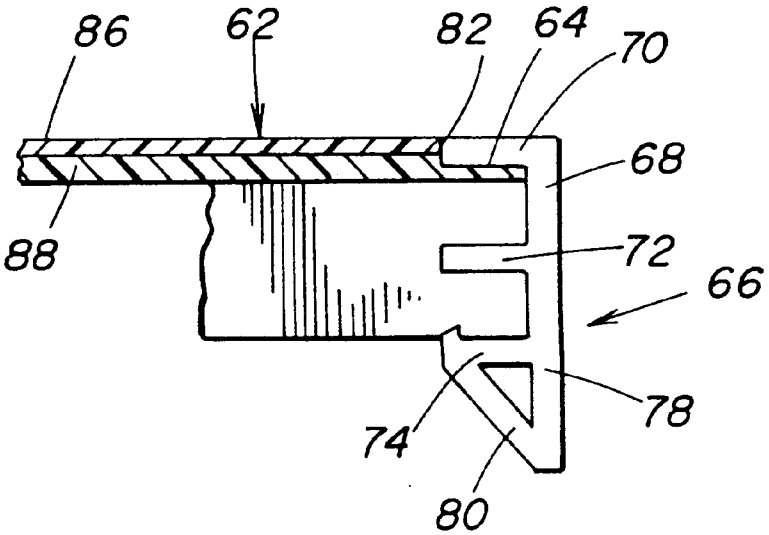
FIG. 5 is an elevation view, in section, illustrating the components of FIG. 4 in the assembled condition.
Figure 3:
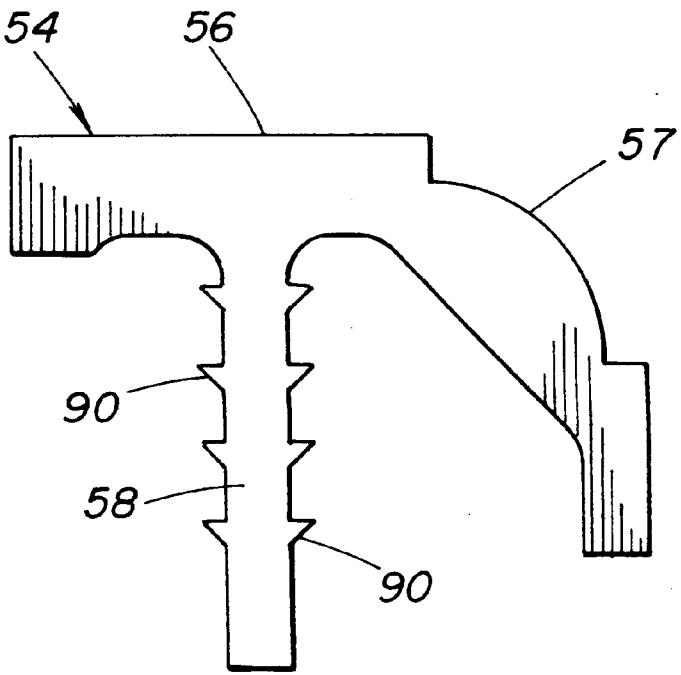
FIG. 3 is a detail end elevation view illustrating a component of the invention.

Finally, viewing especially FIGS. 2, 4, and 5, an edge profile 66 is attached to the front surface 28 of the substrate 22. The edge profile 66 includes an upright bight 68 intended for engagement with the front surface 28 of the substrate 22. A triumvirate of members projects away from the upright bight in the same direction and lie generally in parallel, spaced apart planes. An upper flange 70 is integral with the upright bight 68 and extends transversely from the bight and is engaged (FIG. 5) with the open sided channel 64 of the countertop. An intermediate flange 72 is spaced from the upper flange 70 and similarly to the upper flange is integral with and extends transversely away from the upright bight. The intermediate flange 72 is engaged (FIG. 5) with the second longitudinally extending groove 34 of the substrate 22.

A lower flange 74 is spaced from the intermediate flange in a direction away from the upper flange 70. The lower flange 74 is integral with and extends transversely from the upright bight 68 and is engaged (FIG. 5) with the lower surface 26 of the substrate 22.

More definitively, the edge profile 66 includes a skirt member depending from the bight 68 in a direction away from the upper, intermediate and lower flange members 70, 72, 74, respectively, and a truss member 80 extends between the lower flange 74 at a location spaced from the bight 68 and the skirt member 78 at a location spaced from the lower flange 74.

Edge profile 66 has a PBT outer layer 67 laminated to supporting substrate 71 comprising ABS.

Figures 4A, 4B:
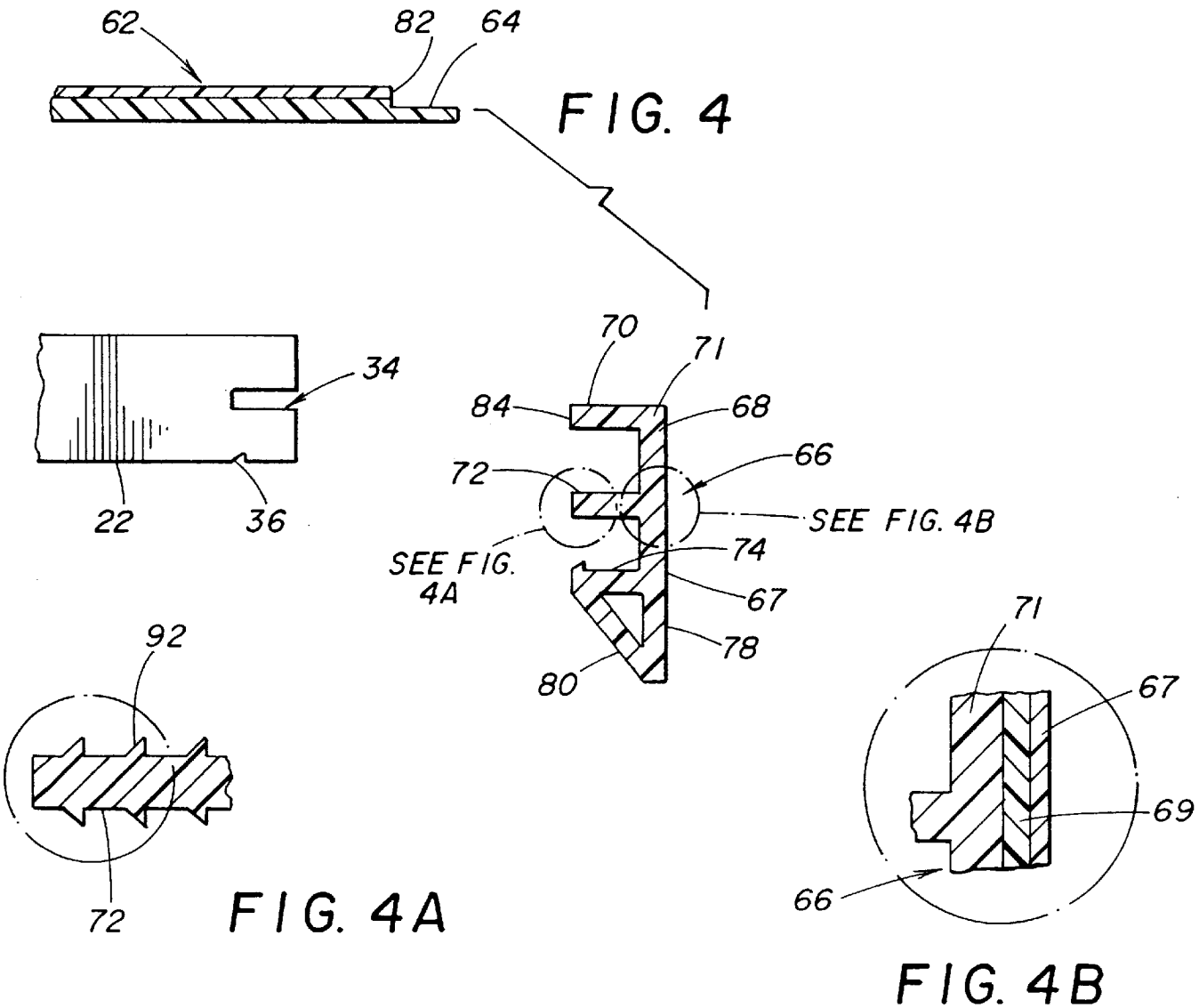
FIG. 4A is detail elevation view, in section, illustrating in still greater detail a portion of FIG. 4.
FIG. 4B is a detailed elevational sectional view of a portion of the edge profile illustrating another embodiment of this invention.

FIG. 4B is a sectional view of a portion of edge profile 66 illustrating a 2 layer composite laminate wherein outer layer 67 and adjoining layer 69 are comprised of PBT with supporting substrate 71 comprised of ABS.

When the countertop assembly 20 is assembled, the upper flange 70, has a length which is substantially equivalent to the depth of the longitudinally extending channel 64 of the plastic countertop 62, is bonded to the plastic countertop using any suitable adhesive. The thickness of the upper flange 70 is substantially equivalent to the thickness of the whole counter top 62 less the thickness of the extending channel 64 so as to give a resulting flush top surface. The thickness of the upper flange 70 and the depth of the channel 64 are precisely controlled as are mating surfaces 82, 84 on the plastic countertop 62 and on the upper flange 70, respectively, such that the interface between the two components effectively becomes invisible after applying the appropriate adhesive. The construction according to which the flange 70 is mounted on the channel 64 of the plastic countertop 62, that is, a plastic to plastic interface, is preferred to better obtain a watertight joint, to obtain a better bond, and to better control tolerances between the two components. This construction therefore better assures that the upper surface of the upper flange will lie in the plane of the upper surface of the plastic countertop 62.

In each instance that a member is said to be composed of plastic material, that is, in the instance of the T-cap member 54, the backsplash member 60, the countertop 62, and the edge profile 66, it is preferably of co-extruded or tri-extruded construction. The thermoplastic composite preferably comprises an extruded thermoformable self-supporting sheet having an outer decorative chemically resistant filled polyester layer and an adjacent thermoplastic support layer for enhancing desirable mechanical properties of the composite. Both layers are formed from extrudable resin compositions. It is contemplated that a compatibilizing or adhering layer may be included intermediate to the decorative layer and the support layer. It is also contemplated that the support layer may be a laminate or multilayered structure including a regrind layer of unused or scrap resin material that are desirable to be recycled. It is also contemplated another polyester layer may be utilized adjacent the support layer so that the entire exterior of the sheet, both top and bottom, are formed from a decorative polyester type material.

In this regard, viewing especially FIG. 4 and FIG. 5, by way of example, the plastic countertop 62 is illustrated as having an outer exposed portion 86 composed of filled polybutylene terephthalate (PBT) thermoplastic polyester and an underlying substantially unexposed portion 88 composed of acrylonitrile-butadiene styrene (ABS) thermoplastic polymer material. As earlier explained, the plastic components of this invention are preferably co-extruded or tri-extruded and the resulting laminated material thus has an overlying surface which is resistant to chemicals, stains, high temperature, soft to the touch, and readily renewable and an underlying surface which exhibits high impact resistance, is recyclable and inexpensive. This assures that the resulting construction exhibits all the desired benefits at a minimum of expense.

Also, in a preferred construction of the invention, the downwardly projecting ledge 58 of the T-cap member 54 includes barbed projections 90 for gripping engagement with the upper longitudinally extending groove 52. In a similar fashion, the intermediate flange 72 of the edge profile 66 includes barbed projections 92 for gripping engagement with the second longitudinally extending groove 34 of the substrate 22.

Although mechanical fasteners may be used for joining the components of the invention, it is preferred that suitable adhesives be used, especially for attaching the plastic components to their underlying substrates. In this manner, the best possible appearance of the end product can be assured.

In the operation of the invention, it is considered that the kit to be offered for sale would include the substrate 22, preformed with the grooves 32 and 34, the properly sized plastic countertop 62 preformed with the channel 64, and the upright member 38 preformed with the rib 48 and upper groove 52. It is contemplated that rib 48 and groove 32 may not be present so that a flat uninterrupted surface 42 mates with a flat uninterrupted surface 50. A complete kit may include the edge profile 66, and/or the T-cap 54, and may also include the appropriate adhesive for bonding the parts together either before or after the parts have been properly trimmed for the custom installation.

While preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. A countertop assembly comprising:

a substantially rigid substrate having substantially flat upper and lower surfaces extending between front and rear surfaces lying in planes transverse to said upper and lower surfaces, and a longitudinally extending groove into said front surface intermediate said upper and lower surfaces, an upright member including upper and lower spaced surfaces and front and rear spaced surfaces and having a longitudinally extending groove in said upper surface of said upright member;

a finishing T-cap member of a thermoplastic material having a planar head and an integral downwardly projecting ledge fittingly engaged with the upper longitudinally extending groove such that said planar head is engaged with coextensively overlies said upper surface of said upright member;

a plastic backsplash member mounted on and coextensively overlying said front surface of said upright member;

a thermoplastic countertop mounted on and coextensively overlying said upper surface of said substrate to a location uniformly spaced from said rear surface of said substrate thereby defining a mounting region and having an open sided longitudinally extending channel adjacent said front surface of said substrate; and an edge profile attached to said front surface of said substrate including an upright bight engaged with said front surface of said substrate, an upper flange integral with and extending transversely from said upright bight engaged with the open sided channel of said countertop, an intermediate flange spaced from said upper flange and integral with and extending transversely from said upright bight and engaged with the front longitudinally extending groove of said substrate, and a lower flange spaced from said intermediate flange in a direction away from said upper flange and integral with and extending transversely from said upright bight engaged with the said lower surface of said substrate, wherein said edge profile includes a skirt member depending from said bight in a direction away from said upper, intermediate and lower flange members, and a trust member extending between said lower flange at a location spaced from said bight and said skirt member at a location spaced from said lower flange.

2. a countertop assembly as set forth in claim 1 wherein said upper flange of said edge profile is bonded to the longitudinally extending channel of said thermoplastic countertop which lies in a plane of said upper surface of said thermoplastic countertop having an outer thermoplastic surface wherein said flange has an upper surface which lies in the same plane as the upper surface of said countertop.

3. A countertop assembly as set forth in claim 1 wherein each of said T-cap member, said backsplash member, said countertop, and said edge profile is of co-extruded or tri-extruded construction, having an outer exposed portion or portions composed of filled polybutylene terephthalate and an underlying substantially unexposed portion composed of acrylonitrile butadiene styrene.

4. A countertop assembly as set forth in claim 1 wherein said downwardly projecting ledge of said T-cap member includes means for gripping engagement with the upper longitudinally extending groove.

5. A countertop assembly as set forth in claim 1 wherein said upright member has as an underlying longitudinally extending rib fittingly engaged with a longitudinally extending groove in said upper surface of said substrate for firmly mounting said upright member on said mounting region of said substrate with said lower surface of said upright member engaged with said upper surface of said substrate.

6. In combination:

a substantially rigid substrate having substantially flat upper and lower surfaces extending between front and rear surfaces lying in planes transverse to said upper and lower surfaces, said substrate having a first longitudinally extending groove into said front surface intermediate said upper an lower surfaces and having a second longitudinally extending groove into said upper surface proximate to and spaced from said rear surface;

a thermoplastic countertop mounted on and coextensively overlying said upper surface of said substrate to a location uniformly spaced from said rear surface of said substrate thereby defining a mounting region and having an open sided longitudinally extending channel adjacent said front surface of said substrate; and an edge profile attached to said front surface of said substrate including an upright bight engaged with said front surface of said substrate, an upper flange integral with and extending transversely from said upright bight engaged with the open sided channel of said countertop, an intermediate flange spaced from said upper flange and integral with and extending transversely from said upright bight and engaged with the front longitudinally extending groove of said substrate, and a lower flange spaced from said intermediate flange in a direction away from said upper flange and integral with and extending transversely from said upright bight engaged with the said lower surface of said substrate, wherein said edge profile includes a skirt member depending from said bight in a direction away from said upper intermediate and lower flange member, and a truss member extending between said lower flange at a location space from said bight and said skirt member at a location spaced from said lower flange.

7. A countertop assembly as set forth in claim 6 wherein said upper flange is bonded to the longitudinally extending channel of said thermoplastic countertop and has an upper surface which lies in the plane of said upper surface of said plastic countertop.

8. A countertop assembly as set forth in claim 7 wherein each of said countertop and said edge profile is of co-extruded or tri-extruded construction, having an outer exposed portion or portions composed of filled polybutylene terephthalate and an underlying substantially unexposed portion composed of acrylonitrile butadiene styrene.

9. A countertop assembly as set forth in claim 8 wherein said intermediate flange includes means for gripping engagement with the second longitudinally extending groove of said substrate.

* * * * *